US011332283B2

(12) United States Patent
Liu

(10) Patent No.: US 11,332,283 B2
(45) Date of Patent: May 17, 2022

(54) SAFE SELF-SEALING BAG

(71) Applicant: QINGDAO DEJILI PACKAGING TECHNOLOGY CO., LTD., Qingdao (CN)

(72) Inventor: Chao Liu, Qingdao (CN)

(73) Assignee: QINGDAO DEJILI PACKAGING TECHNOLOGY CO., LTD., Qingdao (CN)

( * ) Notice: Subject to any disclaimer, the term of this patent is extended or adjusted under 35 U.S.C. 154(b) by 0 days.

(21) Appl. No.: 16/966,016

(22) PCT Filed: Oct. 24, 2019

(86) PCT No.: PCT/CN2019/113005
§ 371 (c)(1),
(2) Date: Jul. 30, 2020

(87) PCT Pub. No.: WO2021/056656
PCT Pub. Date: Apr. 1, 2021

(65) Prior Publication Data

US 2021/0347530 A1 Nov. 11, 2021

(30) Foreign Application Priority Data

Sep. 29, 2019 (CN) ..... 201921647489.6

(51) Int. Cl.
*B65D 33/25* (2006.01)

(52) U.S. Cl.
CPC ..... *B65D 33/2541* (2013.01)

(58) Field of Classification Search
CPC ..... B65D 33/2541; B65D 33/2508
USPC ..... 383/63
See application file for complete search history.

(56) References Cited

U.S. PATENT DOCUMENTS 6,217,215 B1 * 4/2001 Tomic ..... B65D 33/2541 24/DIG. 50
10,011,403 B1 * 7/2018 Kirsh ..... B65D 50/00
10,011,404 B1 * 7/2018 Kirsh ..... B65D 33/007
10,427,839 B2 * 10/2019 Johnston ..... B65D 33/20
10,507,959 B2 * 12/2019 Kirsh ..... B65D 33/007
(Continued)

FOREIGN PATENT DOCUMENTS

CN 208842896 U * 5/2019 ..... B65D 33/2566
CN 110194319 A * 9/2019
(Continued)

*Primary Examiner* — Jes F Pascua
(74) *Attorney, Agent, or Firm* — Bayramoglu Law Offices LLC

(57) ABSTRACT

A safe self-sealing bag includes a double-sided bag body and a sealing strip. The sealing strip includes a first fastening strip and a second fastening strip. Two long side edges of the first fastening strip are hermetically attached to one of inner side faces of the bag body. A long side edge of the second fastening strip away from the bag opening is hermetically attached to the other inner side face of the bag body. A double-layer bag area is arranged on a bag surface provided with the first fastening strip, and the double-layer bag area is arranged on a side of the first fastening strip away from the bag opening. A side edge of the double-layer bag area away from the first fastening strip is provided with an opening, and the opening is located on the outer side layer of the double-layer bag area.

9 Claims, 5 Drawing Sheets

(56) References Cited

U.S. PATENT DOCUMENTS

| | | | | |
|---|---|---|---|---|
| 10,689,162 | B2 * | 6/2020 | Tameda | B65D 33/2566 |
| 2003/0223654 | A1 * | 12/2003 | Gerrits | B65D 33/2541<br>383/63 |
| 2019/0315524 | A1 * | 10/2019 | Huang | B65D 33/2508 |

FOREIGN PATENT DOCUMENTS

| | | | | |
|---|---|---|---|---|
| JP | 2016098033 | A * | 5/2016 | |
| WO | WO-2019148454 | A1 * | 8/2019 | B65D 33/2533 |
| WO | WO-2020006354 | A1 * | 1/2020 | B65D 33/2566 |
| WO | WO-2020206856 | A1 * | 10/2020 | B65D 33/25 |

* cited by examiner

SAFE SELF-SEALING BAG

CROSS REFERENCE TO THE RELAYED APPLICATIONS

This application is the national phase entry of International Application No. PCT/CN2019/113005, filed on Oct. 24, 2019, which is based upon and claims priority to Chinese Patent Application No. 201921647489.6, filed on Sep. 29, 2019, the entire contents of which are incorporated herein by reference.

TECHNICAL FIELD

The present invention relates to the technical field of sealing bags, and more particularly to a safe self-sealing bag.

BACKGROUND

Self-sealing bag can be sealed only by means of the engagement of the self-sealing strip at the opening of the bag. It has numerous advantages such as moisture-proof, waterproof, anti-pollution and so on. It is widely used in food, jewelry, medicine, cosmetics, frozen food, philatelic items, chemical pharmaceutical and other industries. The sealing structure of the self-sealing bag is formed by installing a sealing strip at the opening of the bag to achieve a fastening seal. When intended to open the sealing bag, two hands pull both sides of the opening of the bag outward to unfasten the sealing strip. The sealing bag is easily opened in this way. Such easy opening, however, also brings great risks to unknowing children and toddlers because they are extremely likely to open the bag, which may contain dangerous articles causing bodily injury or death.

SUMMARY

In order to solve the problems of the prior art, the present invention provides a safe self-sealing bag, which requires certain dexterity skills to open the self-sealing bag, effectively prevents children from opening the self-sealing bag and contacting the goods in the self-sealing bag, and thus avoids danger.

The objective of the present invention can be realized by the following technical solution.

A safe self-sealing bag includes a double-sided bag body and a sealing strip arranged at an inner side of a bag opening of the bag body. Two ends of the sealing strip are sealed at two sides of the bag body. The sealing strip includes a first fastening strip and a second fastening strip capable of sealing each other. Two long side edges of the first fastening strip are hermetically attached to one of inner side faces of the bag body. A long side edge of the second fastening strip away from the bag opening is hermetically attached to the other inner side face of the bag body. A double-layer bag area is arranged on a bag surface provided with the first fastening strip, and the double-layer bag area is arranged on a side of the first fastening strip away from the bag opening. A side edge of the double-layer bag area away from the first fastening strip is provided with an opening, and the opening is located on the outer side layer of the double-layer bag area. The outer side layer is located on the outer side face of the bag body.

Preferably, a side edge of the double-layer bag area next to the first fastening strip overlaps with and is hermetically attached to a long side edge of the first fastening strip away from the bag opening.

Preferably, the double-layer bag area has a rectangular shape, and a length edge of the double-layer bag area is parallel to the long side edge of the first fastening strip.

Preferably, two short edges of the rectangular double-layer bag area are hermetically attached to the two side edges of the bag body, respectively.

Preferably, the opening at the double-layer bag area is a slit.

Preferably, a concave bar and a convex rib, which are engaged with each other for sealing, are arranged at opposite side faces of the first fastening strip and the second fastening strip, and the concave bar and the convex rib are arranged in pairs. The concave bar is arranged on the first fastening strip, and the convex rib is arranged on the second fastening strip. Two protruding tooth-shaped buckles are arranged on a side face of the convex rib facing towards the bag opening, and a side face of the convex rib back towards the bag opening is an arc-shaped transitional surface. The inner concave contour of the concave bar is matched to the outer convex contour of the convex rib. The number of pairs of the concave bar and the convex rib is at least two.

Preferably, edges of the bag opening are hermetically attached to each other.

A method for opening the self-sealing bag of the present invention is as follows:

step 1: tearing off the sealing line at the edges of the bag opening; and step 2: reaching into the double-layer bag area and pinching the outer side layer by the fingers of the first hand, and pinching the side edge of the bag opening provided with the second fastening strip by the second hand, wherein the two hands pinch a position next to the sealing strip where the force is applied; forcefully pulling the outer side layer perpendicularly toward the bag opening tightly along the bag surface of the bag body, while forcefully pulling by the second hand in the opposite direction relative to the first hand at an angle of 180°, so as to pull the sealing strip apart from the force points.

In addition, in step 2, when the first hand reaches into the double-layer bag area and pinches the outer side layer, the pinching position is preferred next to the two ends of the opening.

The present invention has the following advantages.

The present invention has the advantages of simple and reasonable structure and convenient use. The two long side edges of the first fastening strip are hermetically attached to the bag body, and the long side edge of the second fastening strip away from the bag opening is hermetically attached to the bag body, so when the two sides of the bag opening are pinched and pulled, the whole sealing strip is pulled toward the bag surface affixed with the first fastening strip, and thus the sealing strip cannot be torn off when only pulling the two sides of the bag opening outward. When the outer side layer and the side edge of the bag opening affixed with the second fastening strip are simultaneously pinched and synchronously pulled in opposite directions, the force point is a pair of the concave bar and the convex rib on the sealing strip farthest away from the bag opening. The force point acts on the same pair of the concave bar and the convex rib, which ensures that in this case, the pulling force point of the concave bar is identical to the pulling force point of the convex rib, so that the sealing bag can be easily pulled open. Moreover, the tooth-shaped buckle is arranged on the side face of the convex rib facing towards the bag opening, and the side face of the convex rib back towards the bag opening is the arc-shaped transitional surface, so it is difficult to open the sealing strip downward along the bag opening. When the outer side layer and the side edge of the bag opening affixed with the second fastening strip are synchronously pulled in opposite directions, the lower end of the first fastening strip is pulled outward and upward, so the lower end of the concave bar, that is, position where the concave bar is engaged with the arc-shaped transitional surface of the convex rib, is easily pulled apart, which requires skillful dexterity to open the sealing strip. In addition, when the pinching position is selected, the finger pinches and pulls the position near the two ends of the opening of the double-layer bag area. Since the two side edges of the double-layer bag area are hermetically attached to form a pocket shape with the opening downward, so when the finger pinches the area of the pocket shape and pulls the area of the pocket shape in the direction toward the bag opening, the finger substantially hooks the double-layer bag area, which is more labor-saving to tear apart the sealing strip. For the finger that pinches the side edge of the bag opening affixed with the second fastening strip, when the finger pinches the position near the side edge of the bag body, it is also more labor-saving to tear apart the sealing strip. Specially for the bag body made of a smooth material, the labor-saving effect is more obvious when opening the bag body. To sum up, the sealing strip can be easily torn apart only when the corresponding positions are pinched by two hands to cause the bag surfaces of the bag body to move in opposite directions, so that the opening of the self-sealing bag in the present invention requires skilled dexterity. For normal adults, it is easy to open the self-sealing bag, but for children or the mentally disable, it can effectively prevent the self-sealing bag from being opened so as to avoid danger.

BRIEF DESCRIPTION OF THE DRAWINGS

In the figures, the same parts/elements are marked with the same reference numeral, and the drawings are not drawn according to the actual scale.

DETAILED DESCRIPTION OF THE EMBODIMENTS

Figure 1:
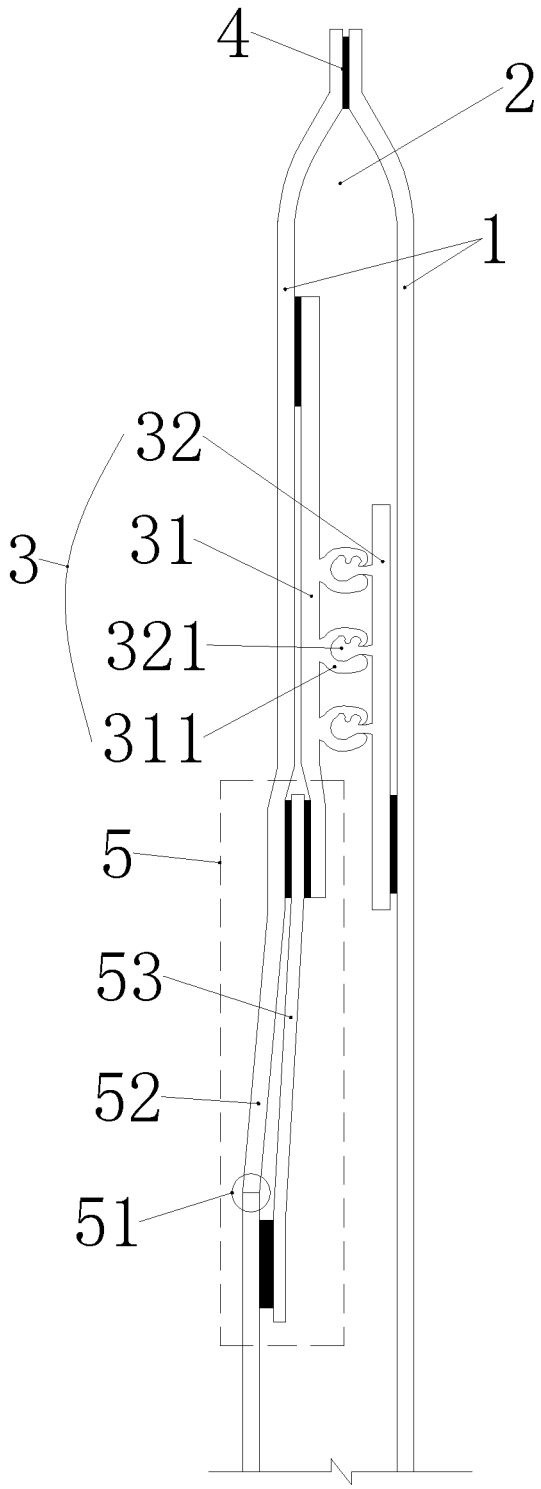
FIG. 1 is a schematic diagram showing the cross-sectional structure of the embodiment of the present invention.
Figure 2:
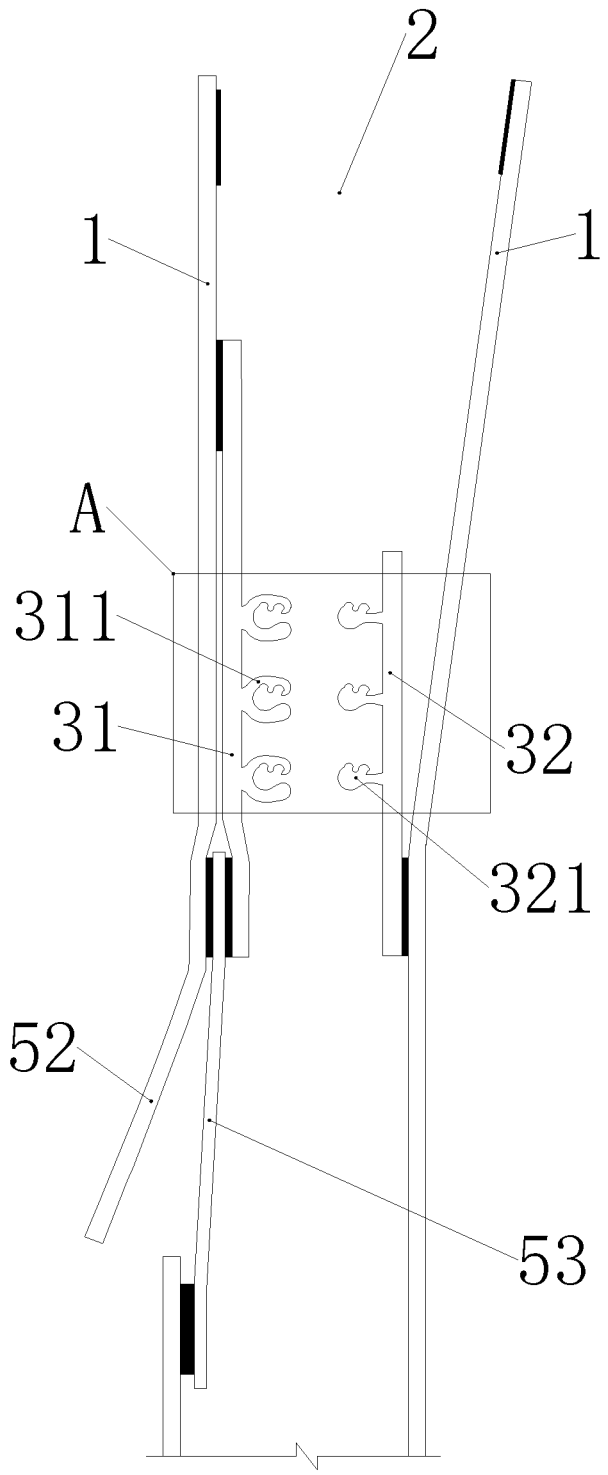
FIG. 2 is a schematic diagram showing the cross-sectional structure of the embodiment of the present invention when the bag body is separated apart.
Figure 3:
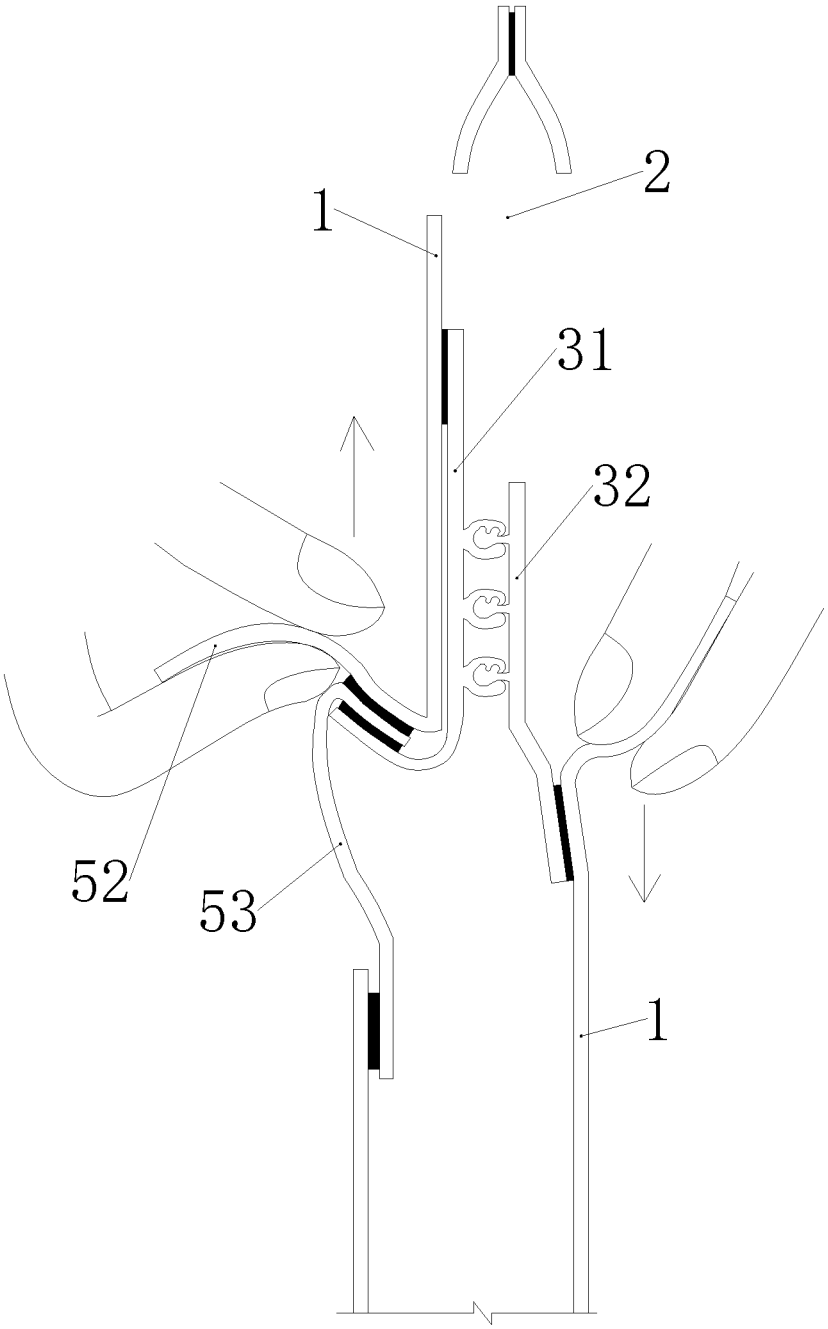
FIG. 3 is a schematic diagram when the embodiment of the present invention is opened.
Figure 4:
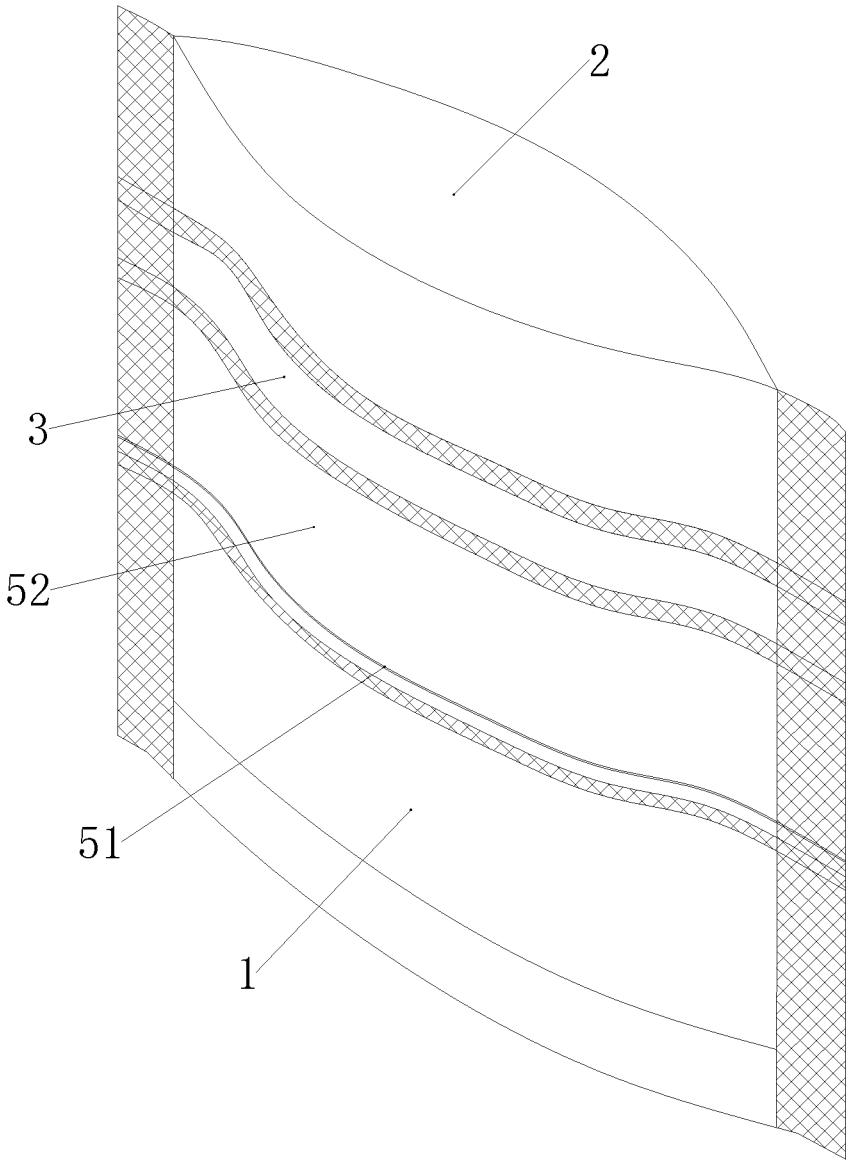
FIG. 4 is a schematic diagram showing the three-dimensional structure of the bag body of the embodiment of the present invention.
Figure 5:
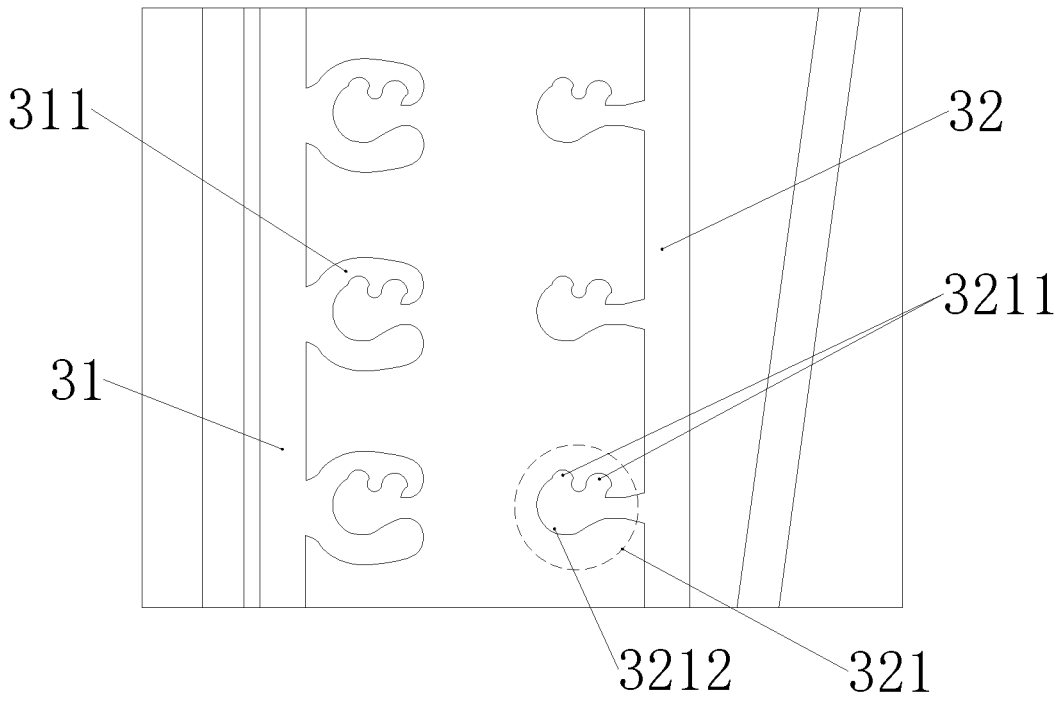
FIG. 5 is a schematic diagram showing the structure of part A in FIG. 2.

The present invention is further described below in conjunction with the drawings and embodiment.

Embodiment

A safe self-sealing bag includes the double-sided bag body 1 and the sealing strip 3 arranged at the inner side of the bag opening 2 of the bag body 1. The edges of the bag opening 2 are thermally sealed as the first sealing line 4 to seal the inside of the bag body 1. The two ends of the sealing strip 3 extend flush with the two side edges of the bag body 1 and are synchronously thermally sealed. The sealing strip 3 includes the first fastening strip 31 and the second fastening strip 32 that can seal each other. The two long side edges of the first fastening strip 31 are thermally sealed with one of the inner side faces of the bag body 1. The long side edge of the second fastening strip 32 away from the bag opening 2 is thermally sealed with the other inner side face of the bag body 1. The concave bar 311 and the convex rib 321, which are mutually engaged and sealed, are arranged at opposite side faces of the first fastening strip 31 and the second fastening strip 32. The concave bar and the convex rib 321 are arranged in pairs. In the present embodiment, the number of pairs of the concave bar 311 and the convex rib 321 is three. The concave bar 311 is arranged on the first fastening strip 31, and the convex rib 321 is arranged on the second fastening strip 32. Two protruding tooth-shaped buckles 3211 are arranged on the side face of the convex rib 321 facing towards the bag opening 2, and the side face of the convex rib 321 nearest the bag opening 2 is the arc-shaped transitional surface 3212. The inner concave contour of the concave bar 311 is matched to the outer convex contour of the convex rib 321.

The double-layer bag area 5 with a rectangular shape is arranged on a bag surface provided with the first fastening strip 31 and away from the bag opening 2. The length edge of the double-layer bag area 5 is parallel to the long side edge of the first fastening strip 31. The side edge of the double-layer bag area 5 next to the first fastening strip 31 overlaps with and is thermally sealed with the long side edge of the first fastening strip 31 away from the bag opening 2. The side edge of the double-layer bag area 5 away from the first fastening strip 31 is provided with an opening, and the opening 51 is located on the outer side layer 52 of the double-layer bag area 5. The outer side layer 52 is located on the outer side face of the bag body 1.

In addition, in order to simplify the production process of the self-sealing bag of the present invention, the specific structure of the double-layer bag area 5 is as follows. The outer side layer 52 of the double-layer bag area 5 is integrally formed with the corresponding side face of the bag body 1. The inner side layer 53 of the double-layer bag area 5 is a thermally sealed adhesive strip. One long side edge of the adhesive strip overlaps with and is thermally sealed with the long side edge of the first fastening strip 31 away from the bag opening 2. The other three edges of the adhesive strip are thermally sealed with the bag body 1 on the same side. The opening 51 of the double-layer bag area 5 is a slit, and the slit may also have a certain width in some other embodiments. Furthermore, in the present embodiment, the two ends of the adhesive strip extend to, overlap with and are thermally sealed with the two side edges of the bag body 1. In some other embodiments, the length of the adhesive strip may be shorter than the length between the two side edges of the bag body 1.

Moreover, when the bag surface of the bag body 1 is made of a shading material, the adhesive strip is made of a transparent material. During use, the outer side layer 52 can be opened directly from the opening 51 of the double-layer bag area 5 to observe the objects in the bag body 1, so as to check the goods in the bag without the need of opening the self-sealing bag.

A method for opening the self-sealing bag of the embodiment of the present invention is as follows.

Step 1: the sealing line at the edges of the bag opening 2 is torn off.

Step 2: the fingers of the first hand reach into the double-layer bag area 5 and pinches the outer side layer 52, and the second hand pinches the side edge of the bag opening 2 provided with the second fastening strip 32. When the first hand reaches into the double-layer bag area 5 and pinches the outer side layer 52, the pinching position is preferred next to the two ends of the opening 51. The two hands pinch the position next to the sealing strip 3 where the force is applied. The first hand forcefully pulls the outer side layer 52 perpendicularly toward the bag opening 2 tightly along the bag surface of the bag body 1, while the second hand forcefully pulls in the opposite direction relative to the first hand at an angle of 180°, so as to pull the sealing strip 3 away from the force points.

The present invention has the advantages of simple and reasonable structure and convenient use. The two long side edges of the first fastening strip 31 are hermetically attached to the bag body 1, and the long side edge of the second fastening strip 32 away from the bag opening 2 is hermetically attached to the bag body 1, so when the two sides of the bag opening 2 are pinched and pulled, the whole sealing strip 3 is pulled toward the bag surface affixed with the first fastening strip 31, and thus the sealing strip 3 cannot be torn off when only pulling the two sides of the bag opening 2 outward. When the outer side layer 52 and the side edge of the bag opening 2 affixed with the second fastening strip 32 are simultaneously pinched and synchronously pulled in opposite directions, the force point is a pair of the concave bar and the convex rib on the sealing strip 3 farthest away from the bag opening 2. The force point acts on the same pair of the concave bar 311 and the convex rib 321, which ensures that in this case, the pulling force point of the concave bar 311 is identical to the pulling force point of the convex rib 321, so that the sealing bag can be easily pulled open.

Moreover, the tooth-shaped buckle 3211 is arranged on the side face of the convex rib 321 facing towards the bag opening 2, and the side face of the convex rib 321 back towards the bag opening 2 is the arc-shaped transitional surface 3212, so it is difficult to open the sealing strip 3 downward along the bag opening 2. When the outer side layer 52 and the side edge of the bag opening 2 affixed with the second fastening strip 32 are synchronously pulled in opposite directions, the lower end of the first fastening strip 31 is pulled outward and upward, so the lower end of the concave bar 311, that is, position where the concave bar 311 is engaged with the arc-shaped transitional surface of the convex rib 321, is easily pulled apart, which requires skillful dexterity to open the sealing strip 3.

In addition, when the pinching position is selected, the finger pinches and pulls the position near the two ends of the opening 51 of the double-layer bag area 5. Since the two side edges of the double-layer bag area 5 are hermetically attached to form a pocket shape with the opening 51 downward, so when the finger pinches the area of the pocket shape and pulls the area of the pocket shape in the direction toward the bag opening 2, the finger substantially hooks the double-layer bag area 5, which is more labor-saving to tear apart the sealing strip 3. For the finger that pinches the side edge of the bag opening 2 affixed with the second fastening strip 32, when the finger pinches the position near the side edge of the bag body 1, it is also more labor-saving to tear apart the sealing strip 3. Specially for the bag body 1 made of a smooth material, the labor-saving effect is more obvious when opening the bag body 1.

To sum up, the sealing strip 3 can be easily torn apart only when the corresponding positions are pinched by two hands to cause the bag surfaces of the bag body 1 to move in opposite directions, so that the opening of the self-sealing bag in the present invention requires skilled dexterity. For normal adults, it is easy to open the self-sealing bag, but for children or the mentally disable, it can effectively prevent the self-sealing bag from being opened so as to avoid danger.

The structure, proportion, size and so on shown in the schematic diagrams attached to this specification are only used to match the contents disclosed in the specification for those skilled in the art to understand and read, and are not used to limit the conditions under which the present invention can be implemented. Therefore, they do not have any technical significance. Any modification of structure, change of proportion or adjustment of size shall still fall within the scope of the technical content disclosed by the present invention without affecting the technical effect and purpose that can be achieved by the present invention. Meanwhile, the terms quoted in this specification, such as "up", "down", "left", "right", "middle" and "one/a", are only for the sake of clarity of the description, and are not used to limit the scope within which the present invention can be implemented. The change or adjustment of the relative relationship shall also be regarded as a category within which the present invention can be implemented without substantive change of the technical content.

The present invention is described with reference to the preferred embodiment, but the scope of protection of the present invention is not limited here. Any other technical solution falling within the scope of the claim shall fall within the scope of protection of the present invention. Various improvements and equivalent replacements of the parts can be made without departing from the scope of the present invention. In particular, the technical features mentioned in the various embodiments can be combined in any way as long as there is no conflict between structures.

What is claimed is:

1. A safe self-sealing bag, comprising a double-sided bag body and a sealing strip arranged at an inner side of a bag opening of the double-sided bag body; wherein, two ends of the sealing strip are sealed at two sides of the double-sided bag body; the sealing strip comprises a first fastening strip and a second fastening strip, and the first fastening strip and the second fastening strip are configured to seal each other; a first long side edge and a second long side edge of the first fastening strip are hermetically attached to a first inner side face of the double-ided bag body; a long side edge of the second fastening strip is away from the bag opening and is hermetically attached to a second inner side face of the double-sided bag body; a double-layer bag area is arranged on a bag surface provided with the first fastening strip, the double-layer bag area is arranged on a side of the first fastening strip, and the side of the first fastening strip is away from the bag opening; a first side edge of the double-layer bag area is away from the first fastening strip and is provided with an opening, and the opening is located on an outer side layer of the double-layer bag area; the outer side layer is located on an outer side face of the double-sided bag body; wherein, a second side edge of the double-layer bag area is next to the first fastening strip, overlaps with and is hermetically attached to the first long side edge of the first fastening strip; and the first long side edge of the first fastening strip is away from the bag opening; wherein, the double-layer bag area further comprises an inner side layer that is an adhesive strip, wherein the adhesive strip is made of a transparent material.

2. The safe self-sealing bag according to claim 1, wherein, the double-layer bag area has a rectangular shape, and the second side edge of the double-layer bag area is parallel to the first long side edge of the first fastening strip.

3. The safe self-sealing bag according to claim 2, wherein, two short edges of the double-layer bag area are hermetically attached to the two sides of the double-sided bag body, respectively.

4. The safe self-sealing bag according to claim 3, wherein, the opening at the double-layer bag area is a slit.

5. The safe self-sealing bag according to claim 4, wherein, a concave bar and a convex rib are mutually engaged with each other and are arranged at opposite side faces of the first fastening strip and the second fastening strip, and the concave bar and the convex rib are arranged in pairs; the concave bar is arranged on the first fastening strip, and the convex rib is arranged on the second fastening strip; two protruding tooth-shaped buckles are arranged on a first side face of the convex rib, and the first side face of the convex rib faces towards the bag opening;

a second side face of the convex rib is back towards the bag opening and is an arc-shaped transitional surface; an inner concave contour of the concave bar is matched to an outer convex contour of the convex rib; a number of pairs of the concave bar and the convex rib is at least two.

6. The safe self-sealing bag according to claim 2, wherein, a concave bar and a convex rib are mutually engaged with each other and are arranged at opposite side faces of the first fastening strip and the second fastening strip, and the concave bar and the convex rib are arranged in pairs; the concave bar is arranged on the first fastening strip, and the convex rib is arranged on the second fastening strip; two protruding tooth-shaped buckles are arranged on a first side face of the convex rib, and the first side face of the convex rib faces towards the bag opening;

a second side face of the convex rib is back towards the bag opening and is an arc-shaped transitional surface; an inner concave contour of the concave bar is matched to an outer convex contour of the convex rib; a number of pairs of the concave bar and the convex rib is at least two.

7. The safe self-sealing bag according to claim 3, wherein, a concave bar and a convex rib are mutually engaged with each other and are arranged at opposite side faces of the first fastening strip and the second fastening strip, and the concave bar and the convex rib are arranged in pairs; the concave bar is arranged on the first fastening strip, and the convex rib is arranged on the second fastening strip; two protruding tooth-shaped buckles are arranged on a first side face of the convex rib, and the first side face of the convex rib faces towards the bag opening;

a second side face of the convex rib is back towards the bag opening and is an arc-shaped transitional surface; an inner concave contour of the concave bar is matched to an outer convex contour of the convex rib; a number of pairs of the concave bar and the convex rib is at least two.

8. The safe self-sealing bag according to claim 1, wherein, a concave bar and a convex rib are mutually engaged with each other and are arranged at opposite side faces of the first fastening strip and the second fastening strip, and the concave bar and the convex rib are arranged in pairs; the concave bar is arranged on the first fastening strip, and the convex rib is arranged on the second fastening strip; two protruding tooth-shaped buckles are arranged on a first side face of the convex rib, and the first side face of the convex rib faces towards the bag opening;

a second side face of the convex rib is back towards the bag opening and is an arc-shaped transitional surface; an inner concave contour of the concave bar is matched to an outer convex contour of the convex rib; a number of pairs of the concave bar and the convex rib is at least two.

9. The safe self-sealing bag according to claim 8, wherein, edges of the bag opening are hermetically attached to each other.

* * * * *